US009957088B2

(12) United States Patent
Jacob et al.

(10) Patent No.: US 9,957,088 B2
(45) Date of Patent: May 1, 2018

(54) MAGNETIC CLOSURE SYSTEM FOR A CONTAINER WITH A WAND-TYPE APPLICATOR AND WIPER

(71) Applicant: ELC Management LLC, Melville, NY (US)

(72) Inventors: Christophe Jacob, Paris (FR); Herve Bouix, New York, NY (US)

(73) Assignee: ELC MANAGEMENT, LLC, Melville, NY (US)

( * ) Notice: Subject to any disclaimer, the term of this patent is extended or adjusted under 35 U.S.C. 154(b) by 81 days.

(21) Appl. No.: 14/865,051

(22) Filed: Sep. 25, 2015

(65) Prior Publication Data

US 2017/0088314 A1 Mar. 30, 2017

(51) Int. Cl.
*A46B 17/08* (2006.01)
*B65D 39/00* (2006.01)
*A45D 40/26* (2006.01)

(52) U.S. Cl.
CPC ..... *B65D 39/0052* (2013.01); *A45D 40/267* (2013.01); *A46B 2200/1053* (2013.01)

(58) Field of Classification Search
CPC .. B65D 39/0052; A45D 40/267; A45D 40/26; A45D 40/18; B43K 8/003; B43K 23/12; A46B 2200/1046; A46B 2200/1053
USPC ..... 401/126–130, 194, 100, 49; 206/385, 206/581; 222/386, 390
See application file for complete search history.

(56) References Cited

U.S. PATENT DOCUMENTS 4,168,129 A * 9/1979 Herrnring ..... B43K 23/126 220/230
6,382,450 B1 5/2002 DeRosa et al.
6,846,122 B1 * 1/2005 Liao ..... B43K 8/003 401/131
6,866,437 B2 3/2005 Gueret
7,780,499 B1 * 8/2010 Truckai ..... A63H 33/088 401/195
7,997,820 B2 * 8/2011 Bouix ..... A45D 40/18 401/126
8,074,666 B2 * 12/2011 Piao ..... A45C 11/008 132/313
8,348,061 B2 1/2013 Komatsuda et al.
(Continued)

FOREIGN PATENT DOCUMENTS

CN 204617383 U 9/2015
FR 2973004 A1 9/2012
FR 2973005 A1 9/2012

OTHER PUBLICATIONS

Written opinion of the ISA PCT/US2016/049381 dated Dec. 6, 2016.

*Primary Examiner* — Jennifer C Chiang
(74) *Attorney, Agent, or Firm* — Peter Giancana

(57) ABSTRACT

A container-closure system that comprises a container (1) without screw threads; a custom wiper (3) that sits in the neck of the container; a magnetic ring (2) that encircles the neck of the container; a custom closure (5) that comprises a handle (5*b*), a conic section (5*g*), a wand (5*d*) and an application surface (4) that depends from the distal end of the wand; an overshell (8) that fits over the handle and supports a metal ring (6). The strength of the magnetic ring for the metal ring is sufficient to effect a tight seal in two sealing zones: between the conic section (5*g*) of the closure and the beveled surface (3*g*) of the wiper (3); and between the bottom (5*a*) of the handle and the custom sealing lip (3*a*) on the top of the wiper.

11 Claims, 8 Drawing Sheets

(56) References Cited

U.S. PATENT DOCUMENTS 8,424,703 B2 4/2013 Meulen
8,443,993 B1 5/2013 Desselle
8,556,527 B1 * 10/2013 Chou ..... A45C 13/1069 215/237
8,556,528 B2 * 10/2013 Gardner ..... A45D 40/265 401/122
8,636,167 B2 1/2014 Hajichristou et al.
8,821,057 B2 * 9/2014 Lambert ..... A45D 40/18 206/385
8,834,052 B2 * 9/2014 Kim ..... A45D 40/26 132/317
8,851,534 B2 10/2014 Fiedler
2004/0168700 A1 * 9/2004 Dorf ..... A45C 11/008 132/313
2005/0031401 A1 * 2/2005 Gueret ..... A45D 34/045 401/129
2007/0014624 A1 * 1/2007 Fogelson ..... A45D 40/18 401/131
2007/0025802 A1 * 2/2007 Dieudonat ..... A45D 40/02 401/100
2007/0199575 A1 * 8/2007 Del Ponte ..... A45C 11/008 132/320
2009/0214285 A1 * 8/2009 Cho ..... A45D 40/24 401/126
2009/0297250 A1 * 12/2009 Huang ..... B43K 5/005 401/243
2010/0003066 A1 * 1/2010 Thorpe ..... A45D 27/04 401/196
2010/0166488 A1 7/2010 Bouix et al.
2011/0073601 A1 * 3/2011 Komatsuda ..... A45C 13/1069 220/230
2011/0129286 A1 6/2011 Gueret
2011/0222955 A1 * 9/2011 Thorpe ..... A45D 34/045 401/122
2011/0297173 A1 * 12/2011 Anderson ..... A45D 40/18 132/218
2012/0219345 A1 * 8/2012 Kim ..... A45D 40/26 401/126
2015/0023718 A1 * 1/2015 Gardner ..... B43K 8/003 401/195
2015/0116287 A1 * 4/2015 Yeh ..... B43K 8/003 345/179
2015/0182005 A1 7/2015 Pires et al.
2016/0058147 A1 * 3/2016 Bemis ..... A45C 13/1069 206/45.2

* cited by examiner

MAGNETIC CLOSURE SYSTEM FOR A CONTAINER WITH A WAND-TYPE APPLICATOR AND WIPER

FIELD OF THE INVENTION

The present invention pertains to a magnetic closure system for containers that have a wand-type applicator and wiper, but no screw threads.

BACKGROUND

Many cosmetic and personal care products are sold in containers that use a threaded or screw-type closure system. Containers that use a lug style closure system also require the closure to rotate relative to the container in order to effect a tight seal. More specifically, when it comes to containers that use a wiper and a wand-type applicator (for example, containers for mascara, lip gloss, and eye shadow) the screw-type, rotating closure system dominates the market. A wiper placed in the neck of a container is generally designed to make a tight seal against the neck. A flange of the wiper lays on top of the landing area of the container. As the closure and container are drawn together through their relative rotation, the closure pushes down on the wiper, and compresses the wiper against the landing area of the container. When the packaging is executed properly, this compression creates an effective seal to protect the product. Typically, the closure rotation stops, and the closure is fully mounted on the container when the wiper cannot be compressed further. This event is generally silent, and is of little or no interest to a user. Furthermore, to create an effective seal, a substantial amount of effort is required every time the container is closed. If twisted to tightly, the closure may be difficult to loosen. For some people, the effort required to effect the relative rotation of the container and closure may be substantial or impossible. These are problems that cry out to be rectified.

OBJECTS OF THE INVENTION

A main object of the invention is to provide an effective alternative to screw-type closures for containers that use a wiper and a wand-type applicator.

For products that use a wand and wiper, another object is to provide a closure-container system that is easier to open, and easier to close while maintaining an effective seal.

Another object is to make dull, wand-type applicators a thing of the past by providing a luxury experience to consumers.

SUMMARY

The present challenges are met by a container and closure as described herein. A container (1) (with or without screw threads) comprises a custom wiper (3) that sits in the neck of the container, and one or more magnetic elements (2) that encircle the neck of the container. A closure (5) comprises an overshell (8) that supports a handle (5*b*) and one or more ferromagnetic elements (6). A conic section (5*g*) depends from the handle, and a wand (5*d*) depends from the conic section. The wand supports an application surface (4) on its distal end.

As a user inserts the application surface and wand into the container through the wiper, the magnetic elements (2) attract the ferromagnetic elements (6) until the magnetic and ferromagnetic elements make contact, or until they are a predetermined distance apart. The result is a satisfying, reassuring metallic "click" sound, accompanied by a luxurious tactile sensation. The strength of the magnetic elements (2) for the ferromagnetic elements (6) is sufficient to effect a tight seal in two sealing zones: between the conic section (5*g*) of the closure and the beveled surface (3*g*) of the wiper (3); and between the bottom (5*a*) of the handle and the custom sealing lip (3*a*) on the top of the wiper. To open the container, a user merely has to pull the container and closure apart, preferably by tilting the closure in relation to the container, so that some of the contact between the magnetic and ferromagnetic elements is reduced.

DESCRIPTION OF THE FIGURES

FIG. 8A depicts a custom wiper for use in the present invention. FIG. 8B is a cross section of FIG. 8A, through line A-A. FIG. 8C is a close up view of section A of FIG. 8B.

DETAILED DESCRIPTION

Figure 1:
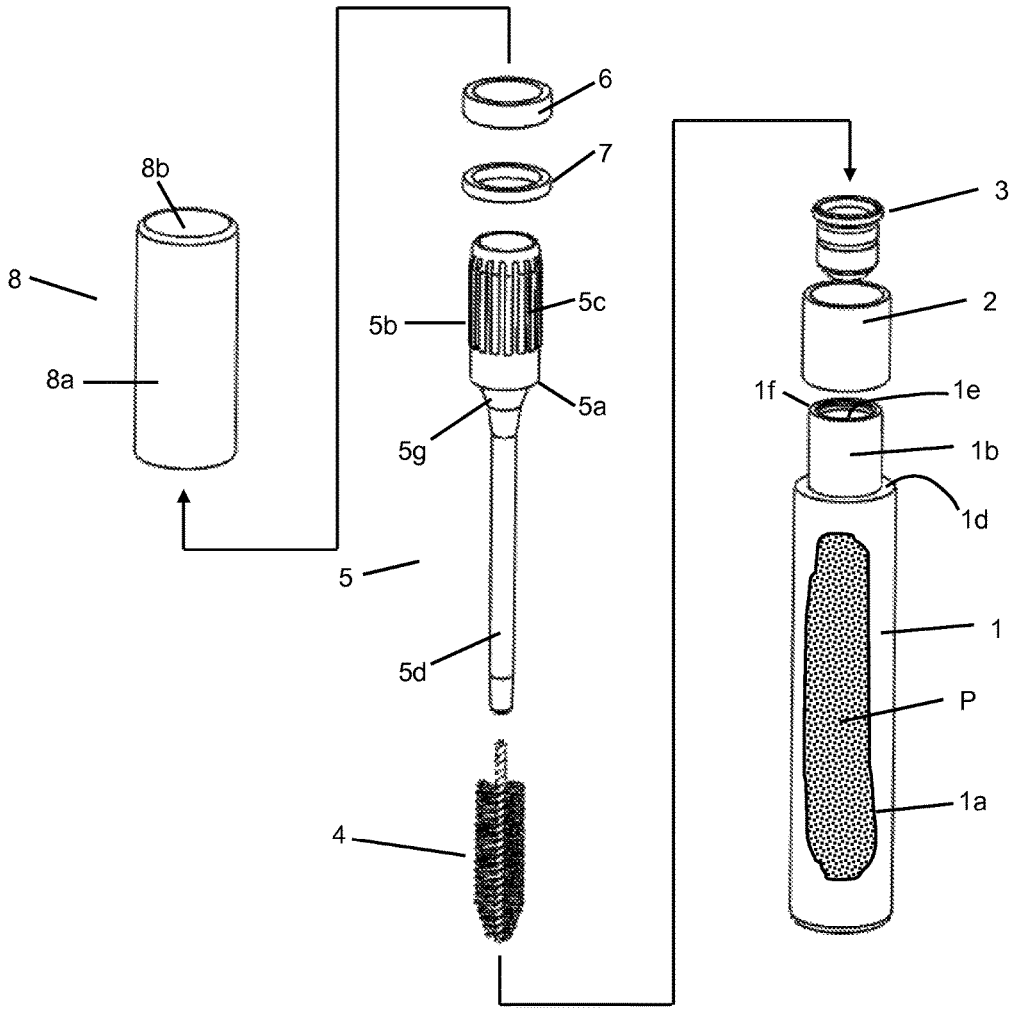
FIG. 1 is an exploded view of a container-closure system of the present invention.

FIG. 1 depicts a container (1) that has a shoulder (1*d*) that supports a neck (1*b*). The top of the neck is referred to as the landing area (1*f*). The container is suitable for holding a cosmetic product, a personal care product or essentially any product (P) in its internal reservoir (1*a*). The product may be accessed through an opening (1*e*) in the neck of the container that leads form the exterior of the container into the reservoir (1*a*). Preferably, and as shown in FIG. 1, the container does not have screw threads, which might only get in the way of the container and closure operation.

Figure 2:
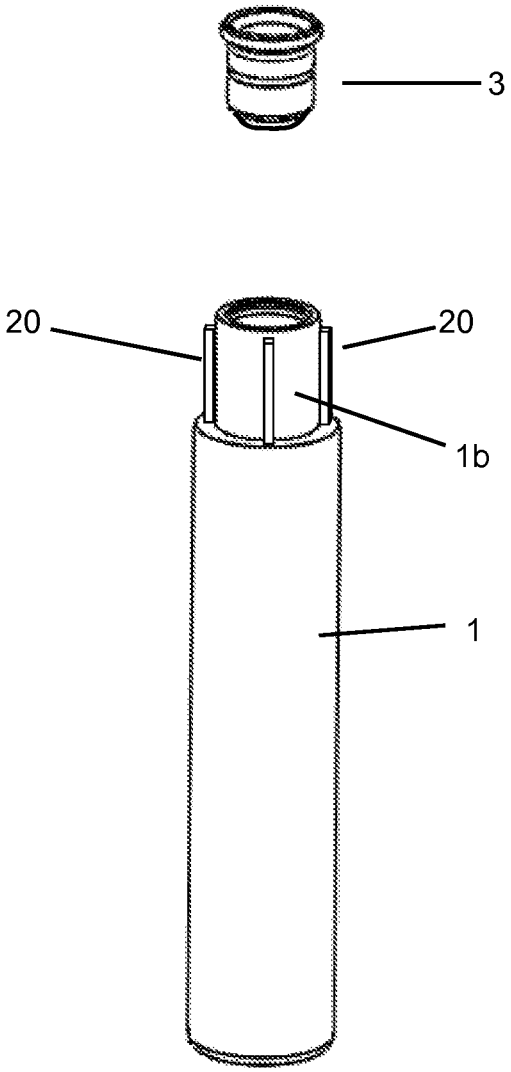
FIG. 2 shows an alternate embodiment of the magnets positioned on the neck of the container.

One or more magnetic elements are associated with the container (1), in the area around the neck (1*b*). The magnetic element(s) must be securely attached to neck and able to interact with one or more ferromagnetic elements (6) of the overshell (8). Thus it is preferable if the one or more magnetic elements are positioned close to the top of the neck, near the landing area (1*f*), and preferably distributed around the circumference of the neck (1*b*). In the preferred embodiment shown in FIG. 1, a magnetic ring (2) is placed over the neck (1*b*) of the container. The magnetic ring may rest on the shoulder (1*d*) of the container, as shown, while the top of the magnetic ring is slightly higher than the landing area (1*f*) of the neck (1*b*). The magnetic ring may be attached to the container (1) by any suitable means, such as adhesive. The container of FIG. 1 does not have threads, which is preferred, but a container with threads may still benefit from the invention if the magnetic ring is sized to fit around the threads. In that case, the threads will not be accessible and will be hidden. In an alternative embodiment several bar magnets (20) (i.e. from two to six) are attached to the neck (1*b*) of the container (1) in an equiangular arrangement around the circumference of the neck, as shown in FIG. 2.

In some preferred embodiments, the one or more magnetic elements (2) are metallic. For the ring magnet shown in the FIG. 1, the inner diameter of the ring should just fit over the neck of the container (1). Preferably, the external diameter does not extend beyond the shoulder (1*d*) of the container. For example, the thickness of the ring magnet will be less than about 5 mm, preferably less than 3 mm. The height of the ring magnet can vary, but if the magnet rests on the shoulder (1*d*) of the container, then the height of the ring magnet should extend to the top of the neck (1*b*), or a little beyond that.

Examples of potentially useful magnets include hard ferrite magnets, which are cost effective; AlNiCo (aluminum-nickel-cobalt) magnets, which are permanent metallic magnets; SmCo (samarium-cobalt) magnets, which are permanent metallic rare earth magnets. One preferred magnet is a ring of NdFeB (neodymium-iron-boron), having a magnetization grade of N45, and having a preferred internal diameter of 12 mm, and preferred external diameter of 14 mm, a preferred height of 14.5 mm. Of course depending of the packaging design these dimensions can be adjusted. N45 is a standard neodymium-iron-boron grade for which the maximum energy product ($BH_{max}$) ranges from 43 to 46 MGOe (megaGause-Oersteds; 1 MGOe is approximately equal to 7957.74715 J/m$^3$). Useful magnets of invention may have a maximum energy product in the range of about 10 to about 100 MGOe, preferably about 25 to about 75 MGOe, more preferably about 40 to about 50 MGOe. However, the magnetic field experienced by the one or more ferromagnetic elements (6) in the overshell (8) will also depend on the shape and mass of the magnet. Some potentially useful magnets will have an axial magnetization and a mas off about 100 grams to about 1000 grams.

Figure 3:
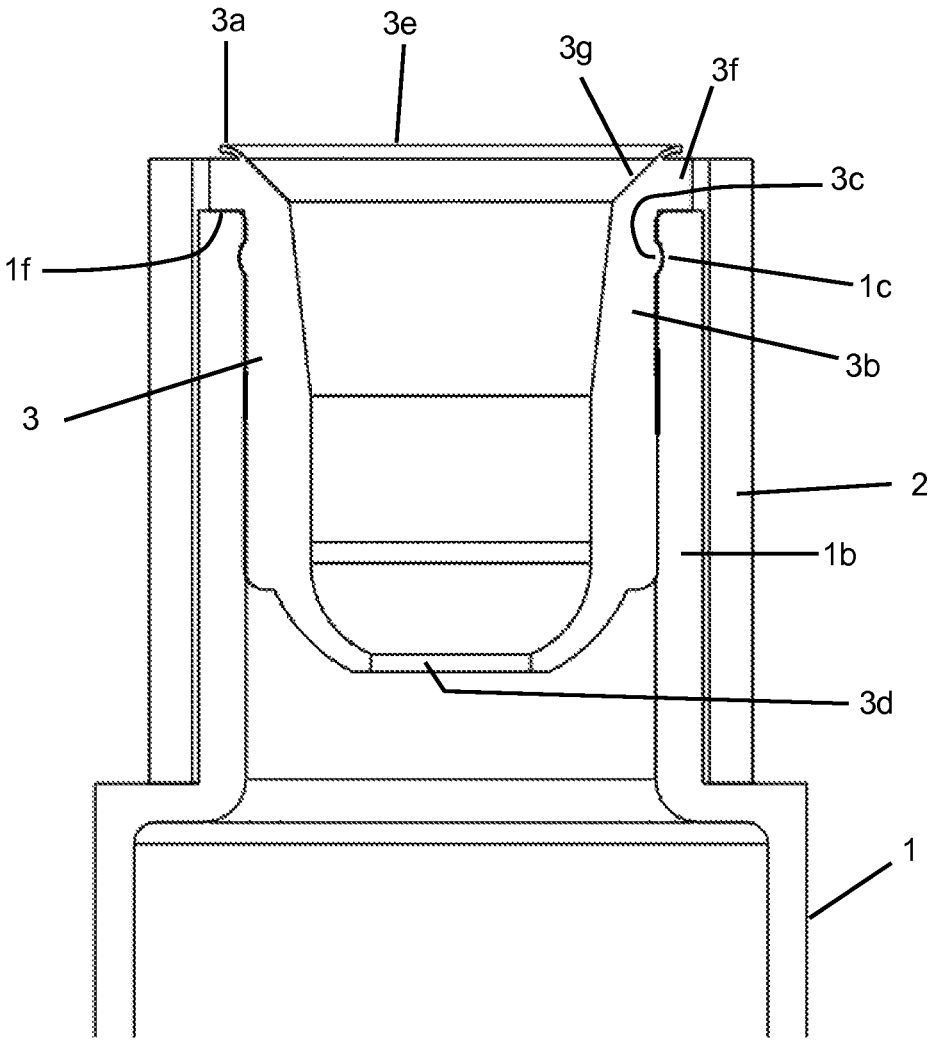
FIG. 3 shows one embodiment of a custom wiper for use in the present invention.

Referring to FIG. 3, a wiper (3) is located, in the usual manner, in the opening (1*e*) of the neck (1*b*) of the container (1), except for the flange (3*f*) of the wiper, which rests on the landing area (1*f*) of the neck. The wiper has an upper opening (3*e*) and a lower opening (3*d*) which has a diameter. The wiper distributes product evenly on the application surface (4), and removes excess product from the application surface as the application surface is drawn through the wiper. The wiper is held in the neck by friction between an outer wall (3*b*) of the wiper and the inner wall of the neck (1*b*). For additional retention, the wiper may be provided with a bead (3*c*) that rests in the groove (1*c*) of the neck.

Up to now, we have described features of a conventional wiper, which may be suitable for some embodiments of the invention. However, when airtight sealing of the container (1) must be guaranteed, it is preferable to use a custom wiper, as now described. In a custom wiper according to the present invention, the upper opening (3*e*) is surrounded by a beveled surface (3*g*). Furthermore, where the beveled surface meets the flange (3*f*), a sealing lip (3*a*) extends upwardly and outwardly from the beveled surface. In some preferred embodiments of the invention, the sealing lip is formed as a flat flap that encircles the upper opening (3*e*) of the wiper. The beveled surface (3*g*) and sealing lip (3*a*) interact with a custom closure (5) to form an effective airtight seal. Preferably, the beveled surface (3*g*) and the sealing lip (3*a*) are molded from relatively flexible thermoplastic elastomers, such as polyurethanes or polyesters having a Shore hardness less than about 50. This flexibility improves the airtightness in the sealing zones of the beveled surface and sealing lip. It is also preferable for the lower opening (3*d*) to be molded from relatively flexible thermoplastic elastomers. This is because molded brushes generally require a wiper orifice that is molded from flexible material to avoid any damage to the molded bristles during the wiping.

Figure 4:
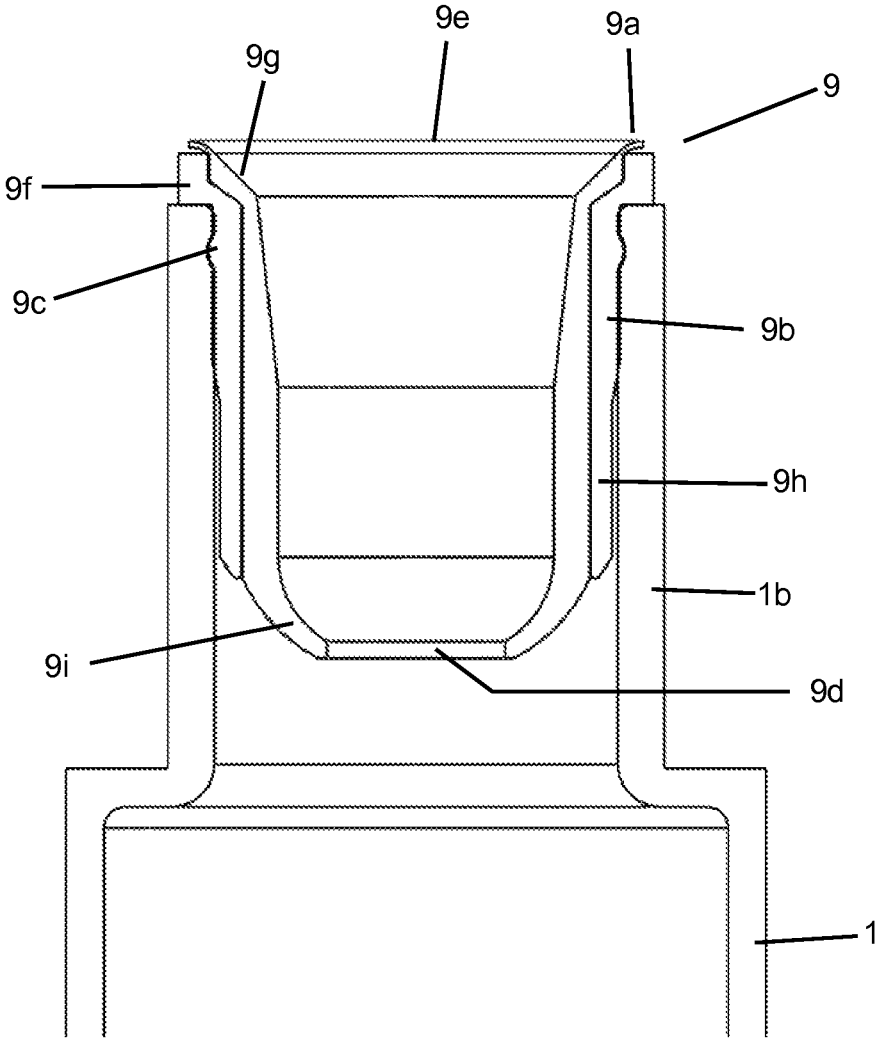
FIG. 4 shows another embodiment of a custom wiper for use in the present invention.
Figure 8A:
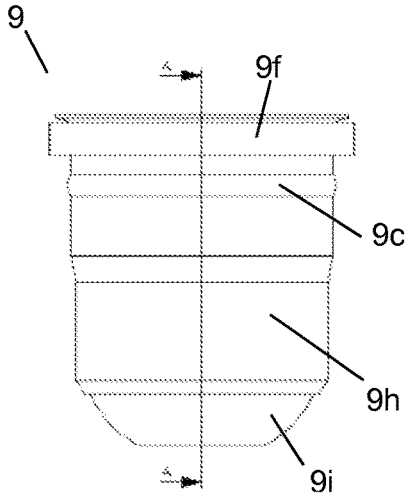
FIGS. 8A, 8B and 8C depict the same component.
Figure 8B:
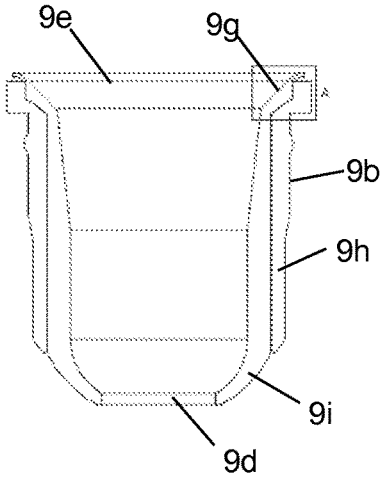
Figure 8C:
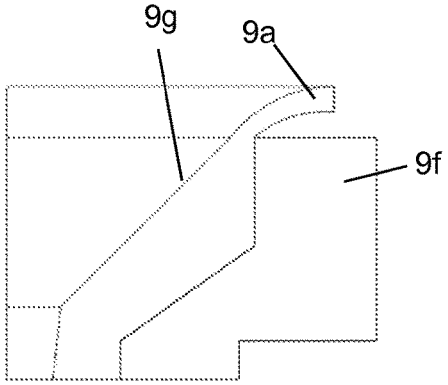
Figure 9:
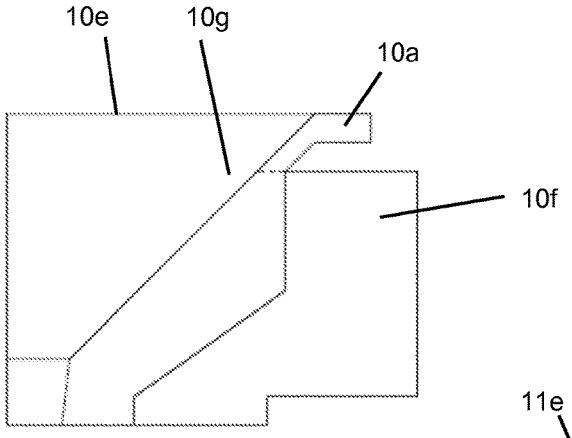
FIGS. 9, 10 and 11 are analogous to FIG. 8C. Each shows a close up section of an alternate embodiment of a custom wiper.
Figure 10:
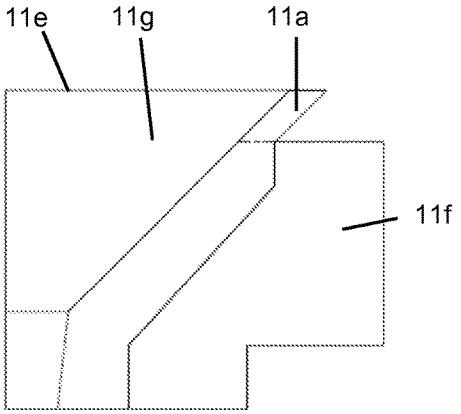
Figure 11:
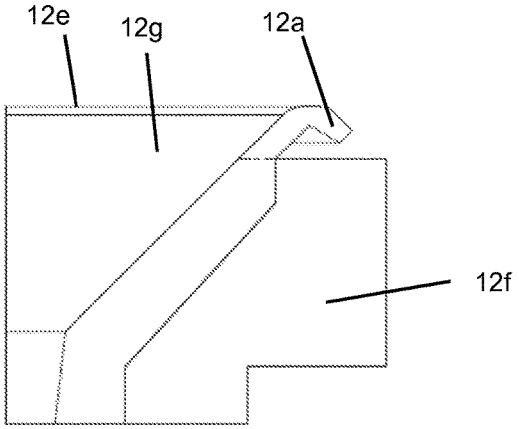

The custom wiper (3) of FIG. 3 may be single injection molded as one piece. FIG. 4, however, depicts an alternative embodiment of a custom wiper according to the present invention. We have noted that the wiper is held in the neck (1*b*) of the container (1) by friction between an outer wall (3*b*) of the wiper and the inner wall of the neck (1*b*), and, for additional retention, the wiper may be provided with a bead (3*c*) that rests in the groove (1*c*) of the neck. However, to ensure a good retention force between the wiper and the neck, it is preferable if an outer wall of the wiper is molded from a rigid plastic resin having a Shore hardness of at least about 70. Thus, preferred custom wipers according to the invention will have sealing and wiping zones that are relatively flexible, as described above, and retention zones that are relatively rigid. FIG. 4 depicts a preferred wiper (9) that is made by bi-injection molding. An external body (9*h*) is fashioned from a rigid plastic resin such as low density polyethylene or polypropylene, and an internal body (9*i*) is fashioned from a flexible thermoplastic elastomer, such as polyurethane or polyester having a Shore hardness less than about 50. The internal body of the wiper (9) comprise the sealing lip (9*a*), the beveled surface (9*g*), the upper opening (9*e*), and lower opening (9*d*). The external body (9*h*) comprises the rigid, outer wall (9*b*), the retaining bead (9*c*), and the flange (9*f*). In this way, custom wipers according to the present invention are able to meet the needs for relatively rigid retention zones, as well as the more flexible sealing zones required by a magnetic closure system as described herein. The wiper of FIG. 4 is shown in more detail in FIGS. 8A, 8B and 8C, and preferred variations of the beveled surface (10*g*, 11*g*, 12*g*) and the sealing lip (10*a*, 11*a*, 12*a*), in relation to the flange (10*f*, 11*f*, 12*f*), are shown in FIGS. 9-11. The interaction of the custom wiper with the custom closure (5), is described below.

Figure 5:
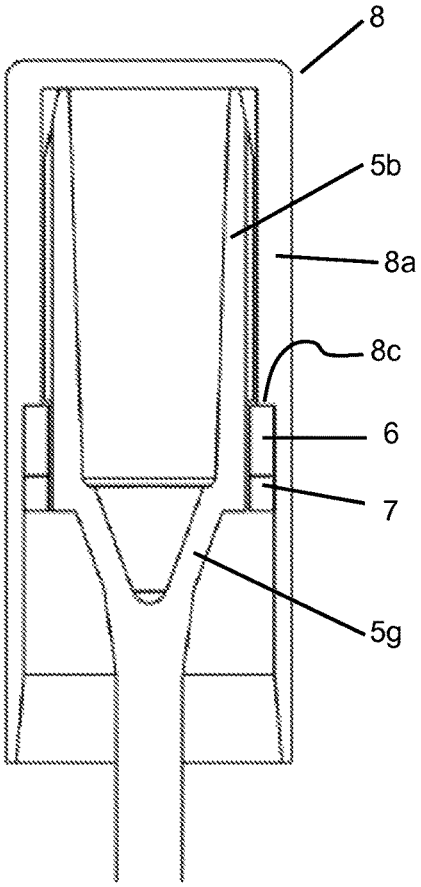
FIG. 5 shows a closure having a conic section and ferromagnetic elements.
Figure 6:
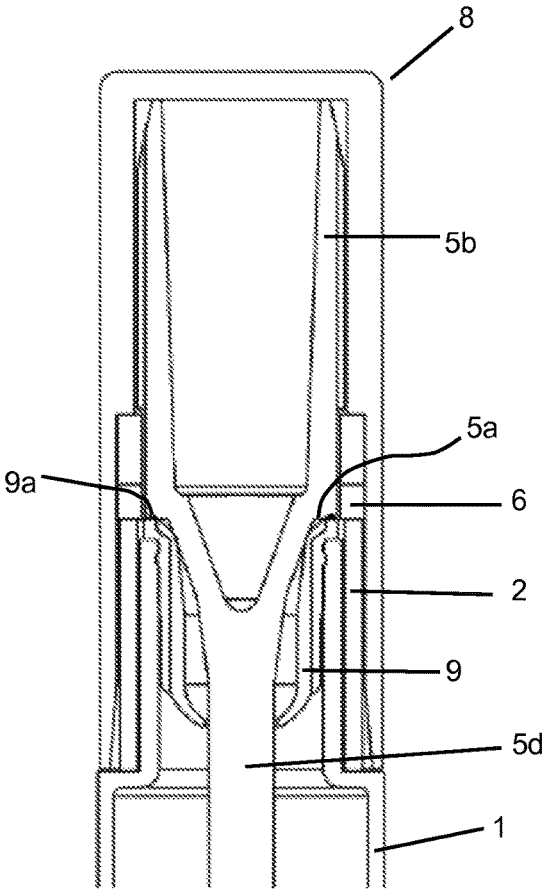
FIG. 6 shows the closure of FIG. 5 seated on a custom wiper according to the invention.
Figure 7:
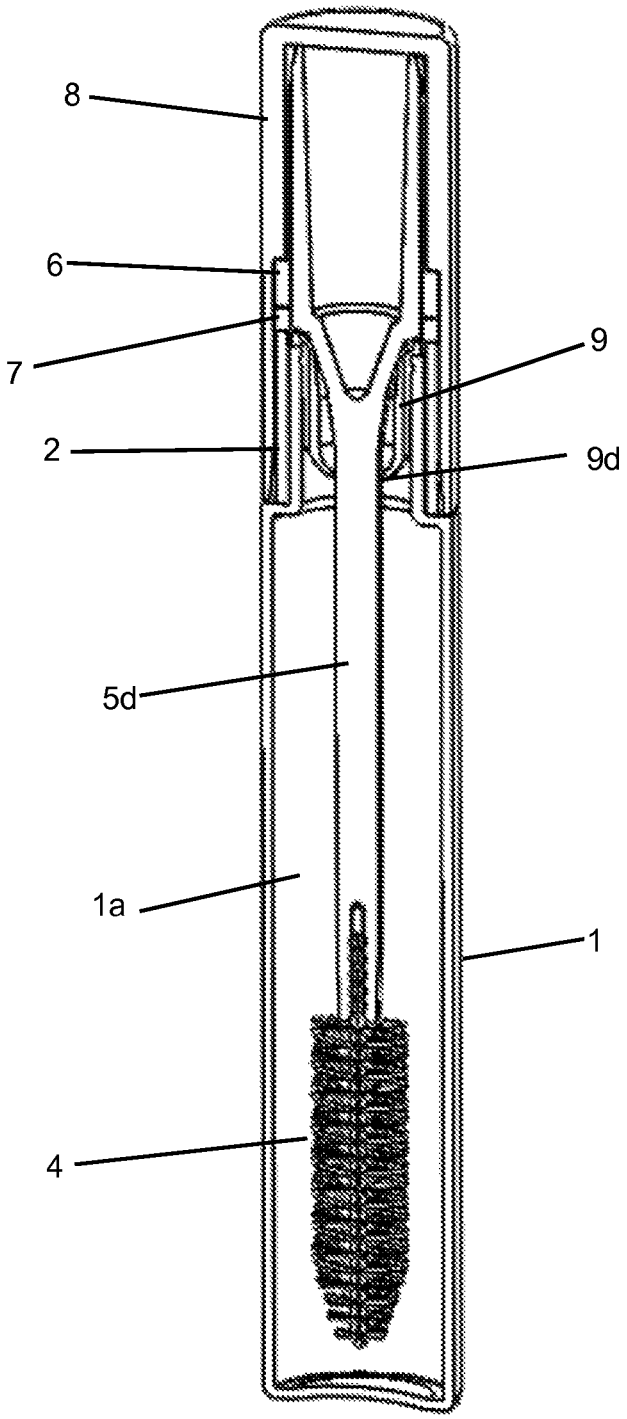
FIG. 7 is an assembled view of a container-closure system of the present invention.

Referring to FIGS. 5-7, the closure (5) comprises an overshell (8) that is attached to a handle (5*b*). One or more ferromagnetic elements (6) are secured in the overshell. A conic section (5*g*) depends from the handle, and a wand (5*d*) depends from the conic section. The wand supports an application surface (4) on its distal end. The overshell, handle, ferromagnetic elements, conic section, wand and application surface are all securely fastened together.

The handle (5*b*) will generally be large enough to be comfortably gasped in the hand of a user. Handles for wand-type applicators are typically cylindrical, from about 10 to about 30 mm in diameter. Usually the diameter of the handle is chosen to match the diameter of the container, although this is not required. The length of the handle may typically range from about 20 mm to about 50 mm, but longer handles are also known. An overshell (8) is provided to give the handle (5*b*) a finished appearance, and to secure one or more ferromagnetic elements around the handle. The overshell fits snuggly over the handle, so that the handle cannot back out of the overshell, in normal use. The handle may be provided with ridges (5*c*, as shown in FIG. 1) that help to secure the overshell onto the handle. Typically, adhesive will also be used for this purpose.

Referring to FIG. 5, the shape of the overshell (8) matches that of the handle (i.e. cylindrical) and comprises a cylindrical wall (8*a*) and a top end (8*b*). One or more ferromagnetic elements (6) and an optional plastic ring (7) are permanently secured in the overshell, and this must be done in a way that leaves room for the handle (5*b*), conic section (5*g*) and wand (5*d*). To that end, a recess (8*c*) is situated on the inner surface of the cylindrical wall (8*a*). The recess accommodates the one or more ferromagnetic elements (6) and optional plastic ring (7). Examples of suitable ferromagnetic materials include iron, nickel, cobalt and alloys that contain ferromagnetic metals, such as steel. In a preferred embodiment, the ferromagnetic element (6) is fashioned as a steel ring (see FIG. 1) that is glued into the overshell (8) at the level of the recess (8*c*). The hole in the steel ring is large enough for the handle, conic section and wand to pass through. The level of the recess (8*c*) and steel ring (6) is chosen so that when the closure (5) is fully seated on the container (1), then the steel ring will contact the magnetic ring (2), before the overshell bottoms out on the shoulder (1*d*) of the container. Thus, the height of the overshell must also be chosen appropriately. The contact between the steel ring (6) and the magnetic ring (2) is shown in FIG. 6.

The conic section (5*g*) depends from the handle (5*b*). The angle of the conic section is steeper than the angle of the beveled surface (3*g*, 9*g*-12*g*)) of the wiper (3, 9-12). However, when the closure (5) is fully seated on the container (1), then the conic section (5*g*) of the closure (5) contacts the beveled surface of the wiper, causing the beveled surface to flex to more nearly match the angle of the conic section, and a sealing engagement is effected 360° around the beveled surface. To ensure good contact between the conic section (5*g*) and the beveled surface (3*g*), the diameter of the conic section, at the level where the conic section contacts the beveled surface, should be slightly larger than the diameter of the beveled surface. Generally the conic section and beveled surface will have an interference from about 0.1 mm to 0.25 mm, preferably about 0.15 mm. This interference provides one seal against leakage. In a package with a threaded closure mechanism, this interference seal would typically be sufficient to prevent leakage. However, since the present package does not use a threaded closure mechanism, a second sealing zone is provided in the form of a sealing lip (3*a*, 9*a*-12*a*) that encircles the upper opening (3*e*, 9*e*-12*e*) of the wiper (3, 9-12). FIG. 6 shows that, in the fully seated position, the bottom (5*a*) of the handle (5*b*) pushes down on the sealing lip (9*a*) of the wiper (9). We have found that the compression of any of the sealing lips (3*a*, 9*a*-12*a*) by the handle, combined with compression of the beveled surfaces (3*g*, 9*g*-12*g*) by the conic section, as effected by the magnetic attraction of the ring magnet (2) for the steel ring (6), is sufficient to make an effective seal. By "effective seal" we mean sufficiently air tight and water tight for commercial purposes.

The wand (5*d*) depends from the conic section and supports an application surface (4) on its distal end. In FIGS. 1 and 7, the application surface is shown as a fiber brush (suitable for mascara application, for example), but any applicator head that is known to be used on a wand type applicator with a wiper system is appropriate. A typical wand (5*d*) is cylindrical, as shown. It is preferable if the diameter of the wand is slightly larger than the diameter of the lower opening (3*d*, 9*d*) of the wiper (3). This will ensure that excess product is wiped off of the wand by the wiper, and creates and additional seal when the wand is stored in the container (1). Preferably, the wand (5*d*), the conic section (5*g*) and the handle (5*b*) are molded as one piece, although these parts may be fashioned separately and assembled thereafter.

As noted, the compression of the sealing lip (3*a*, 9*a*-12*a*) by the handle (5*b*), as effected by the magnetic attraction of the ring magnet (2) for the steel ring (6), is sufficient to make a second effective seal. By "effective seal" we mean sufficiently air tight and water tight for commercial purposes. In fact, depending on the magnet material used, it may be necessary to include a plastic ring (7) to attenuate some of the force of magnetic attraction. If the handle is held on the container too strongly by the magnet, then a user may find it difficult to remove the application surface (4) from the container. When the available magnet is too strong, this situation may be alleviated by placing plastic ring (7) in between the ring magnet (2) and the steel ring (6). The plastic ring may be glued into the overshell (8) or directly onto the steel ring. The plastic ring is shown in FIGS. 5 and 7. Examples of thickness of the plastic ring include from 0.1 mm to 2 mm, preferably from 0.1 mm to 1 mm, more preferably from 0.1 mm to 0.3 mm. By experience with working models of the invention, we know that a plastic ring thickness of about 0.3 mm used with a magnet having a maximum energy product ($BH_{max}$) of about 43 to about 46 MGOe will create a comfortable experience for a user, and an effective seal.

In addition to an effective seal in a non-screw threaded closure system, the force of attraction between the ring magnet (2) and the steel ring (6) is sufficient to make an audible clicking noise when the two elements make contact. As the wand-type applicator is inserted into the container, suddenly the applicator is pulled along by a "magical" force, and it clicks into place. The sound is satisfying and reassuring, and provides the user with a luxury experience. Thus, it is preferable if the ring magnet (2) and the steel ring (6) are able to make solid contact with a force that is sufficient to make an audible clicking noise. But even when a plastic ring (7) is disposed between the two, a sound that acknowledges closure of the container may still be heard.

What is claimed is:

1. A magnetic container-closure system that comprises:

a container (1) that has:

a shoulder (1*d*) that supports a neck (1*b*), the neck having a landing area (1*f*);

an internal reservoir (1*a*) that is suitable for holding a product which may be accessed through an opening (1*e*) in the neck of the container;

a wiper (3) located in an opening (1*e*) of the neck (1*b*) and comprising a lower opening (3*d*) and an upper opening (3*e*) that is surrounded by a beveled surface (3*g*) and a sealing lip (3*a*) that extends upwardly and outwardly from the beveled surface; and one or more magnetic elements (2) attached to the neck (1*b*);

a closure (5) that comprises:

an overshell (8);

a handle (5*b*) that is secured into the overshell;

a conic section (5*g*) that depends from the handle;

a wand (5*d*) that depends from the conic section and that supports an application surface (4) on its distal end;

one or more ferromagnetic elements secured in the overshell;

such that, when the closure (5) is fully seated on the container (1), the attraction of the magnetic elements (2) of the container for the ferromagnetic elements (6) of the closure causes the compression of the sealing lip (3*a*) by the bottom (5*a*) of the handle, and compression of the beveled surface (3*g*) by the conic section (5*g*).

2. The magnetic container-closure system of claim 1 wherein the container (1) does not have screw threads.

3. The magnetic container-closure system of claim 2 wherein the one or more magnetic elements (2) is implemented as a magnetic ring placed over the neck (1*b*) of the container (1), such that the top of the magnetic ring is higher than the landing area (1*f*) of the neck, and the one or more ferromagnetic elements (6) is fashioned as a steel ring.

4. The magnetic container-closure system of claim 3 wherein when the closure (5) is fully seated on the container (1), then the steel ring (6) contacts the magnetic ring (2) before the overshell (8) bottoms out on the shoulder (1*d*) of the container.

5. The magnetic container-closure system of claim 3 wherein the magnetic ring (2) has a maximum energy product in the range of 10 to about 100 MGOe.

6. The magnetic container-closure system of claim 5 wherein the magnetic ring (2) has a maximum energy product in the range of 25 to about 75 MGOe.

7. The magnetic container-closure system of claim 6 wherein the magnetic ring (2) has a maximum energy product in the range of 40 to about 50 MGOe.

8. The magnetic container-closure system of claim 7 wherein the magnetic ring (2) is NdFeB (neodymium-iron-boron) having magnetization grade of N45.

9. The magnetic container-closure system of claim 1 wherein the beveled surface (3*g*) and the sealing lip (3*a*) are molded from a thermoplastic elastomer having a Shore hardness of less than 50.

10. The magnetic container-closure system of claim 1 wherein the application surface (4) is fashioned as a fiber brush.

11. The magnetic container-closure system of claim 1 wherein the wand (5*d*), the conic section (5*g*) and the handle (5*b*) are molded as one piece.

* * * * *